US012560392B2

(12) United States Patent
McCloy

(10) Patent No.: US 12,560,392 B2
(45) Date of Patent: Feb. 24, 2026

(54) ACTION SYSTEM FOR FIREARM

(71) Applicant: McCloy IP, LLC, Gardendale, AL (US)

(72) Inventor: Michael McCloy, Gardendale, AL (US)

(73) Assignee: McCloy IP, LLC, Gardendale, AL (US)

( * ) Notice: Subject to any disclaimer, the term of this patent is extended or adjusted under 35 U.S.C. 154(b) by 0 days.

(21) Appl. No.: 18/778,511

(22) Filed: Jul. 19, 2024

(65) Prior Publication Data

US 2025/0116469 A1 Apr. 10, 2025

Related U.S. Application Data

(60) Provisional application No. 63/542,355, filed on Oct. 4, 2023.

(51) Int. Cl.

| | |
|---|---|
| ***F41C 23/16*** | (2006.01) |
| ***F41A 3/80*** | (2006.01) |
| ***F41A 3/82*** | (2006.01) |

(52) U.S. Cl.

CPC ..... *F41A 3/80* (2013.01); *F41C 23/16* (2013.01)

(58) Field of Classification Search

CPC ..... F41C 23/06; F41A 3/78; F41A 3/80

See application file for complete search history.

(56) References Cited

U.S. PATENT DOCUMENTS

| | | | | | |
|---|---|---|---|---|---|
| 2,731,753 | A * | 1/1956 | Mathieu | F41C 23/06 | 42/1.06 |
| 3,208,179 | A * | 9/1965 | Hrebicek | F41C 23/06 | 42/74 |
| 3,604,138 | A * | 9/1971 | Wilson | F41C 23/06 | 42/74 |
| 3,709,091 | A * | 1/1973 | Perrine | F41A 21/482 | 89/189 |
| 3,732,779 | A * | 5/1973 | Perrine | F41A 5/24 | 89/189 |
| 3,754,344 | A * | 8/1973 | Spiliotis | F41C 23/06 | 42/74 |
| 3,783,739 | A * | 1/1974 | Perrine | F41A 3/50 | 89/189 |
| 4,126,079 | A * | 11/1978 | Perrine | F41A 3/38 | 89/190 |
| 4,183,282 | A * | 1/1980 | Perrine | F41A 3/50 | 89/1.4 |
| 4,467,698 | A * | 8/1984 | Perrine | F41A 21/484 | 89/190 |

(Continued)

*Primary Examiner* — Derrick R Morgan

(74) *Attorney, Agent, or Firm* — AdamsIP, LLC; Edward Brinkley Garner, III; Joseph Andrew Vaccaro

(57) ABSTRACT

An action system for reducing recoil and muzzle rise in firearms is provided. The action system includes an outer housing having an internal cavity, a buffer tube in operable communication with a bolt carrier group of a firearm, and a slidable buffer within the buffer tube. A lever arm, pivotally secured within the outer housing, is operably connected to the buffer and moves radially under the buffer's force. A spring in the cavity engages with the lever arm, compressing as the lever arm is acted upon by the linear force produced by a bolt carrier group until the spring force exceeds the linear force, thus forcing the buffer in a direction opposite the direction of the linear force.

14 Claims, 7 Drawing Sheets

(56) References Cited

U.S. PATENT DOCUMENTS

| | | | | |
|---|---|---|---|---|
| 7,340,857 | B1 * | 3/2008 | Bentley | F41A 25/10 42/1.06 |
| 7,926,216 | B2 * | 4/2011 | Bentley | F41C 23/06 42/1.06 |
| 9,488,433 | B2 * | 11/2016 | Greenwood | F41C 23/02 |
| 2008/0000128 | A1 * | 1/2008 | Newman | F41A 5/02 42/16 |
| 2014/0259845 | A1 * | 9/2014 | Johnson | F41A 19/09 42/69.01 |
| 2024/0077279 | A1 * | 3/2024 | Faifer | F41C 23/06 |

* cited by examiner

ACTION SYSTEM FOR FIREARM

CROSS REFERENCES

This application claims priority to U.S. Provisional Application Ser. No. 63/542,355 filed Oct. 4, 2023, in which said application is incorporated herein in its entirety by reference.

FIELD OF INVENTION

The present disclosure relates to firearms technology, more particularly to action systems for reducing recoil and muzzle rise in firearms.

BACKGROUND

Firearms, particularly those engineered for rapid-fire capabilities, frequently encounter substantial forces during the act of discharging ammunition. These forces can significantly affect the shooter's accuracy and the level of comfort experienced while handling the weapon. In light of recent regulatory changes, there has been an increased focus on the constraints associated with firearm components. This scrutiny has underscored the necessity for innovative designs that not only adhere to stringent legal standards but also elevate the overall user experience.

The components currently available on the market, which are intended to dampen the recoil and other forces generated during firing, may fall short in providing the level of performance required for all firearm variants. This is especially true for firearms with compact barrel designs. The firearms industry acknowledges the pressing need for advanced components that can be effortlessly incorporated into these types of firearms. These improved components are designed to significantly enhance the operational handling and the discharge cycle of the firearm, while simultaneously ensuring that they meet the regulatory mandates and remain user-friendly.

At present, butt stocks are not categorized as an essential element of a firearm's operational mechanism. Consequently, AR pistols, under current regulations, are prohibited from being equipped with a butt stock. The action system utilized in Armalite Rifle models has remained largely unchanged since the inception of the original Armalite Rifle platform. This system typically involves a compression spring and a buffer, both of which travel in a linear path to mitigate the linear force produced by the firearm's upper receiver. There exists a substantial need within the field to develop advancements that refine the traditional action systems used in AR platforms. These advancements would ideally transform the butt stock into a critical component that is integral to the efficient operation of the firearm, thereby enhancing both performance and compliance with legal standards.

Accordingly, there is a need in the art for an action system that replaces the traditional helical spring and works with the cycle of a firearm in a way that reduces recoil and muzzle rise.

SUMMARY

An action system that replaces the butt stock and traditional buffer, resulting in an extension of the firearm's cycle system that is integral to the function of the firearm, is provided. In one aspect, the present invention is an action system that replaces traditional butt stocks and action systems of firearms. In another aspect, the present invention describes a modification to AR-15 or AR-10 style firearms designed to reduce substantial forces during the act of discharging ammunition that considerably impact a shooter's accuracy and the level of comfort experienced while handling the weapon, especially when using rapid follow-up shot capabilities of said AR-15 or AR-10 style firearms. Generally, the present invention replaces traditional, non-essential action systems and/or butt stocks of current AR-15 or AR-10 style firearms with a novel, essential action system that improves performance by reducing recoil and muzzle rise.

The action system comprises a housing with an internal cavity; a buffer tube located within a circular cross-section of the cavity and configured to connect to a lower receiver of the firearm; a buffer configured to slidably move within the buffer tube; a lever arm pivotally secured to a lever point of the housing and operably connected to the buffer, wherein the lever point is located within the internal cavity at a point distal to the buffer tube, wherein the lever arm moves radially when acted upon by a linear force of the buffer; and an action spring positioned within the cavity and in communication with the lever arm, wherein the lever arm moves radially when acted upon by a spring force of the action spring, wherein the action spring is configured to compress as the lever arm moves in the direction of the linear force applied thereto by the buffer when the firearm is fired, wherein compression of the action spring causes the spring force to increase until the spring force is greater than the linear force of the buffer.

The lever arm is preferably pivotally secured to the lever point at a first end of the lever arm and in contact with the buffer at a second end. The action spring is preferably in contact with the lever arm at a point between the first end and the second end, and radial movement of the lever arm towards the second end of the housing compresses the action spring. A plurality of grooves of the housing located within the internal cavity may be configured to hold the action spring in a way such that the spring force is increased while in a resting position, allowing a user to customize the amount of spring force applied to the lever arm by the action spring without the need of changing the action spring. The housing may also comprise an internal/external frame located within the cavity of said housing that is configured to withstand greater forces generated by the firing of a larger caliber firearm, wherein the buffer tube, lever arm, and action spring are operably connected to the internal/external frame, wherein the housing encases the internal/external frame, buffer tube, lever arm, and action spring.

An end stop located at the second end of the casing may be used to work in unison with the lever arm and action spring to reduce the recoil generated when the firearm is fired. In some embodiments, the end stop may comprise an auxiliary spring and be positioned within the buffer tube in a way such that an auxiliary spring force of the auxiliary spring acts on the buffer in a linear direction opposite to the linear force of the buffer being acted on by an upper receiver. In some embodiments, the buffer may comprise a lever groove configured to allow for the lever arm to fit therein, wherein the lever arm slides within the lever groove as the lever moves radially about the lever point and the buffer moves linearly within the buffer tube.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other systems for carrying out the same purpose of the system and method disclosed herein. Those skilled in the pertinent art should also realize that such equivalent designs or modifications do not depart from the scope of the system and method of the present disclosure. For instance, though depicted as a replacement for traditional butt stocks and action systems used in AR-15 or AR-10 style weapon systems, one with skill in the art will recognize that the system and/or method described herein could be used with other firearm systems without departing from the inventive subject matter described herein.

Further, it should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF DRAWINGS

These and other features, aspects, and advantages of the present disclosure will become better understood with regard to the following description, appended claims, and accompanying drawings where:

DETAILED DESCRIPTION

Figure 1:
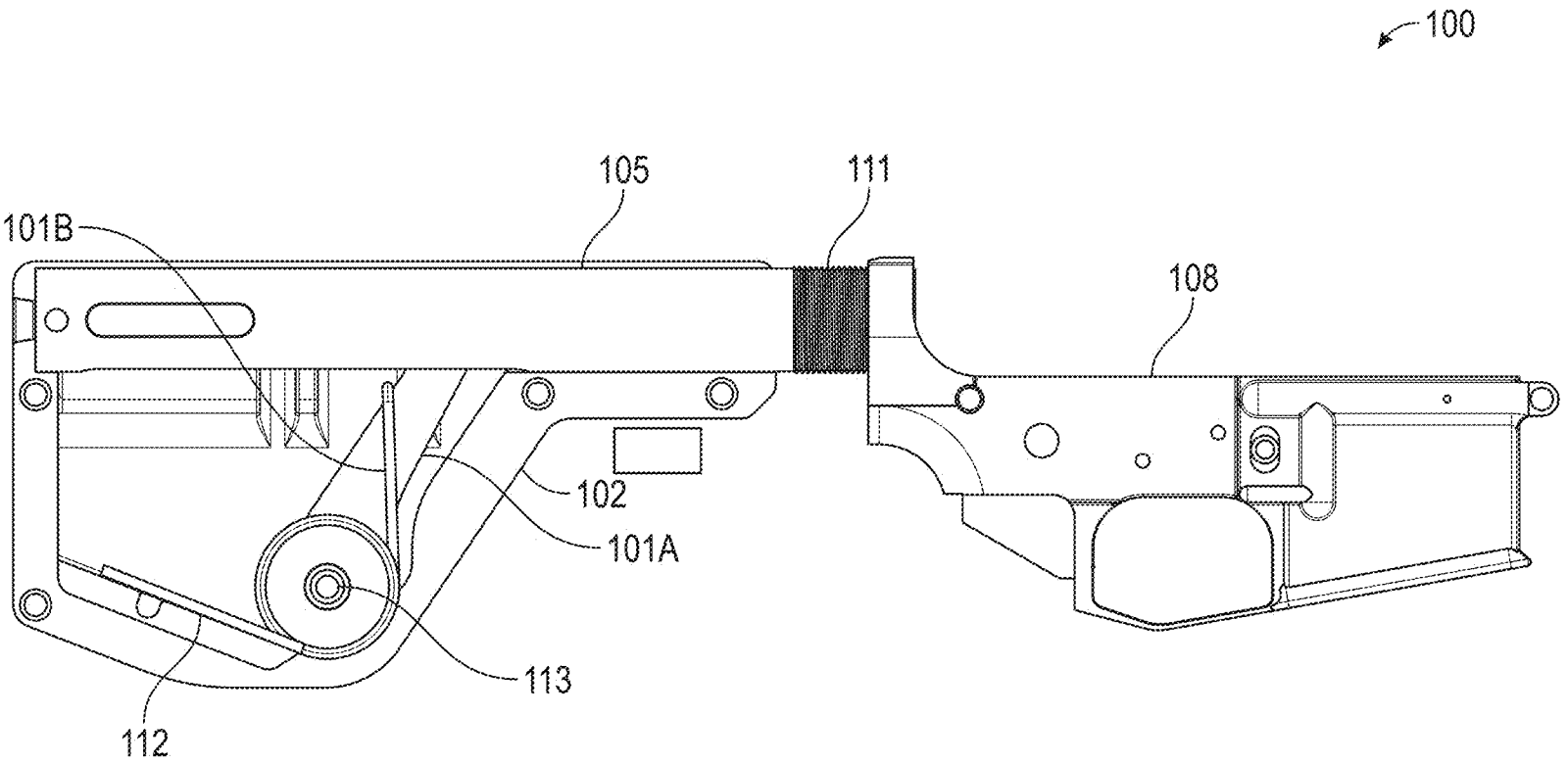
FIG. 1 illustrates a side, cross-sectional view of an action system consistent with principles of the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components. As defined herein, the word substantial means more than half of the length. As will be evident from the disclosure provided, the present invention satisfies the need for an action system that is integral to the function of the firearm.

The system and method described herein is specifically engineered to serve as a replacement for the conventional buffer tube, helical spring buffer, and butt stock, with the aim of integrating these components into a singular, cohesive unit that is essential to the operational mechanics of the firearm. FIGS. 1-7 provide visual representations of an action system 100 that encompasses various combinations of a lever arm 101A, action spring 101B, outer housing 102, buffer 104, buffer tube 105, and end stop 114 operably connected in a manner that reduces recoil and muzzle rise when secured to a firearm platform, preferably that of the ArmaLite Rifle (AR) variety. The ArmaLite Rifle (AR) platform includes, but is not limited to, the AR-10 and AR-15 models. The primary function of the action system 100 is to effectively manage the recoil movement of the bolt carrier group 115 within the firearm, as well as to ensure the proper repositioning of the bolt carrier group 115 subsequent to the discharge of the firearm. Furthermore, the action system's 100 design allows for customization of the recoil response. By adjusting the mass of the buffer 104 or changing the action spring's 101B or end stop's 114 properties, shooters can fine-tune the action system's 100 performance to their individual shooting style or to accommodate different ammunition types. This level of adaptability ensures that the action system 100 can cater to a wide range of preferences and requirements, making it a versatile solution for recoil management in AR platform firearms.

Figure 2:
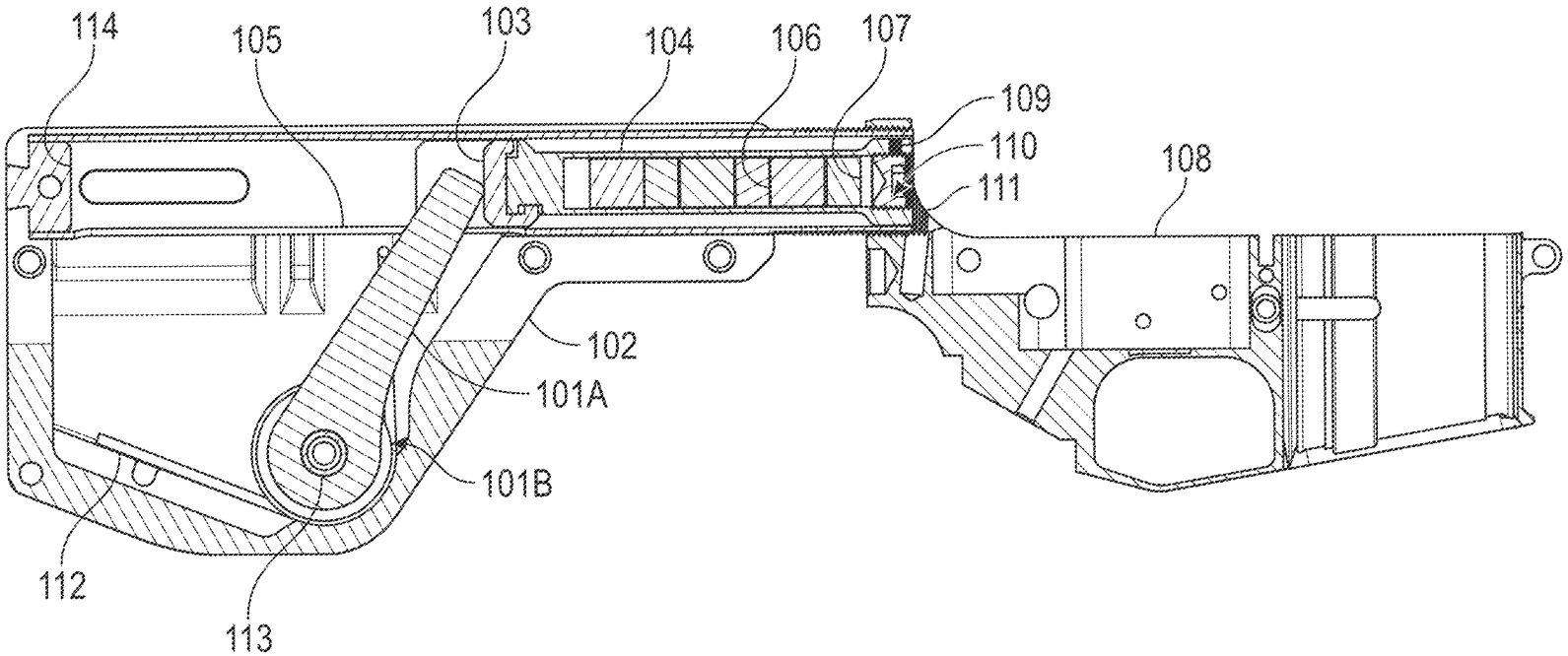
FIG. 2 illustrates a side, cross-sectional view of an action system in a resting position and consistent with principles of the present disclosure.
Figure 3:
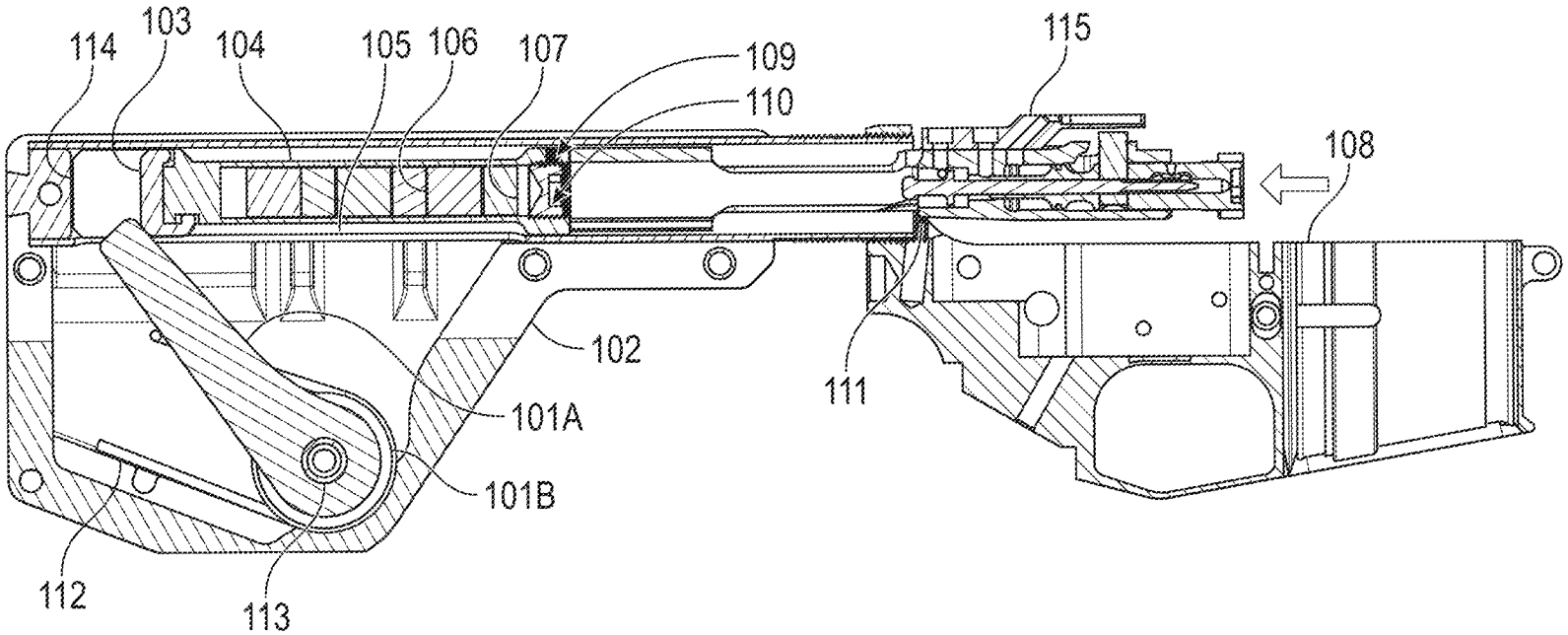
FIG. 3 illustrates a side, cross-sectional view of an action system in a fired position and consistent with principles of the present disclosure.
Figure 4:
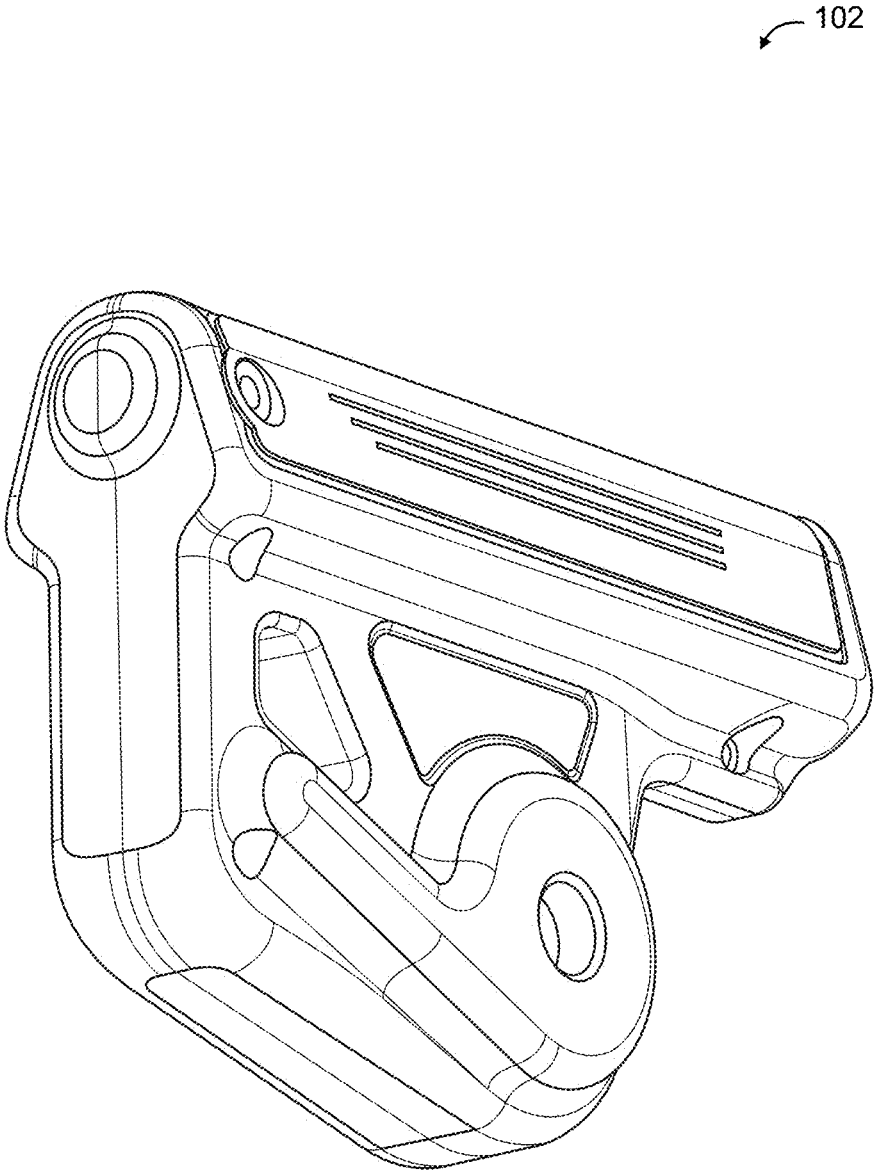
FIG. 4 illustrates a perspective view of an exterior surface of a housing of an action system and consistent with principles of the present disclosure.
Figure 5:
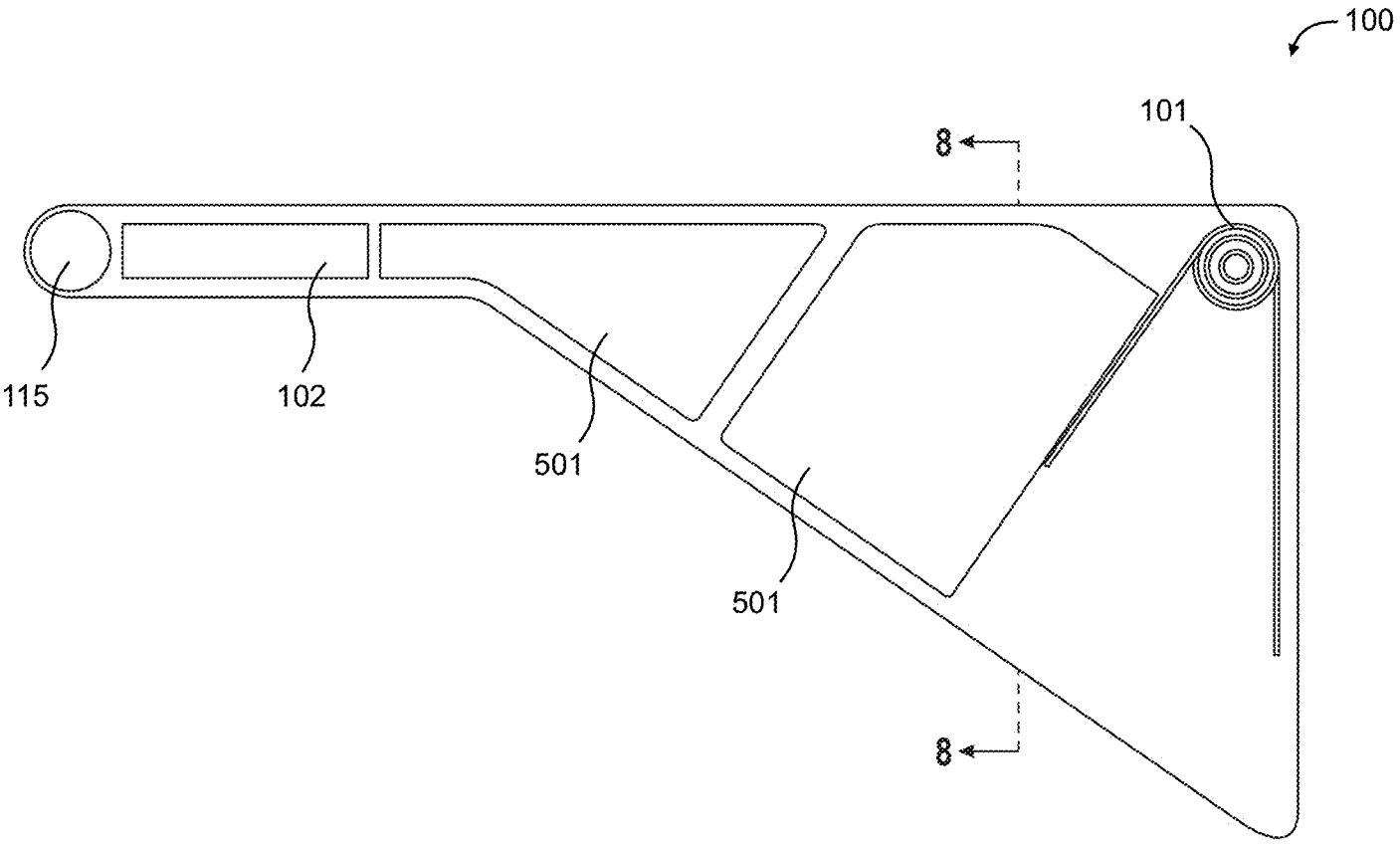
FIG. 5 illustrates a side, cross-sectional view of an alternative embodiment of an action system and consistent with principles of the present disclosure.
Figure 6:
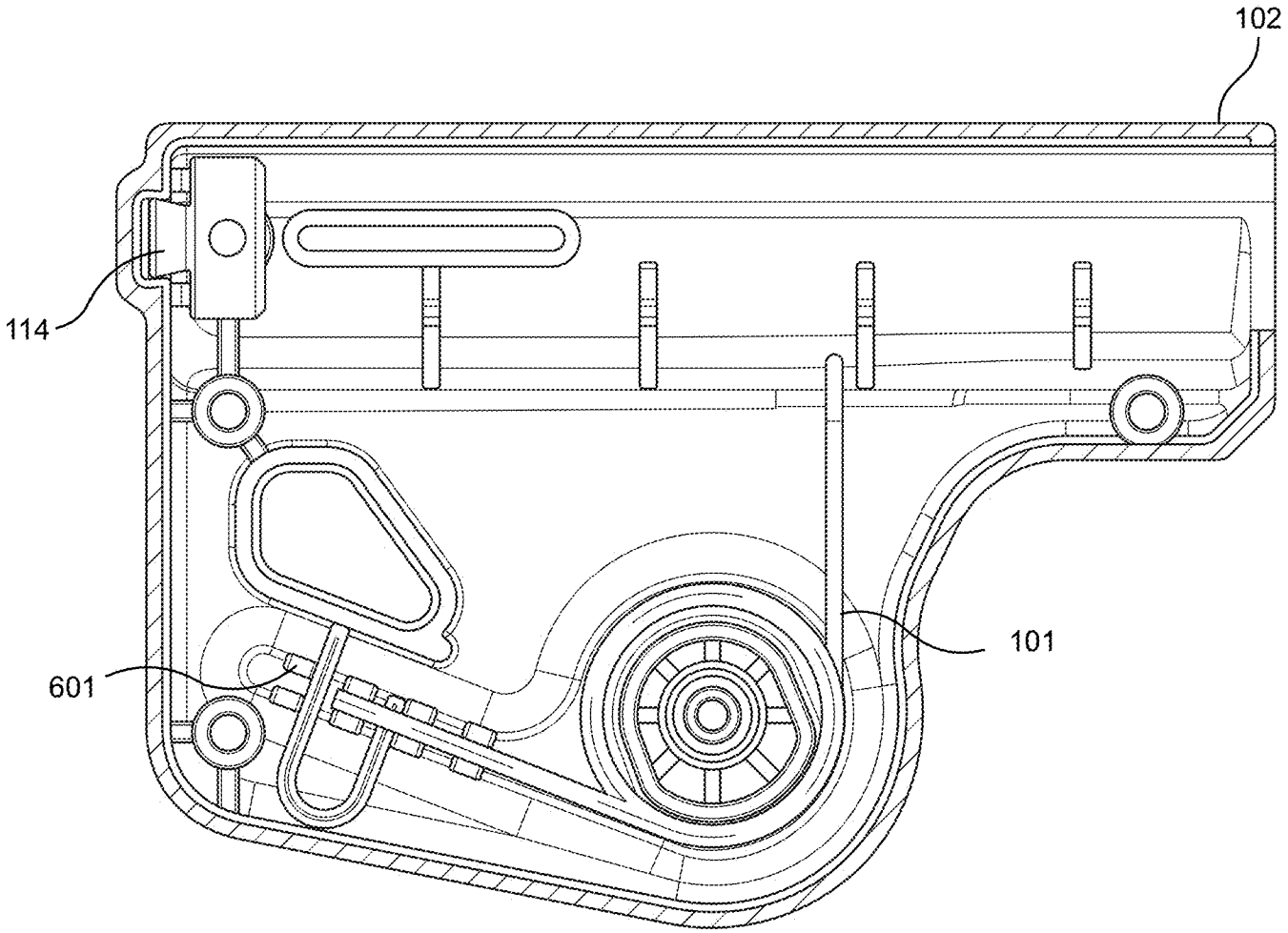
FIG. 6 illustrates a side, cross-sectional view of an alternative embodiment of an action system and consistent with principles of the present disclosure.
Figure 7:
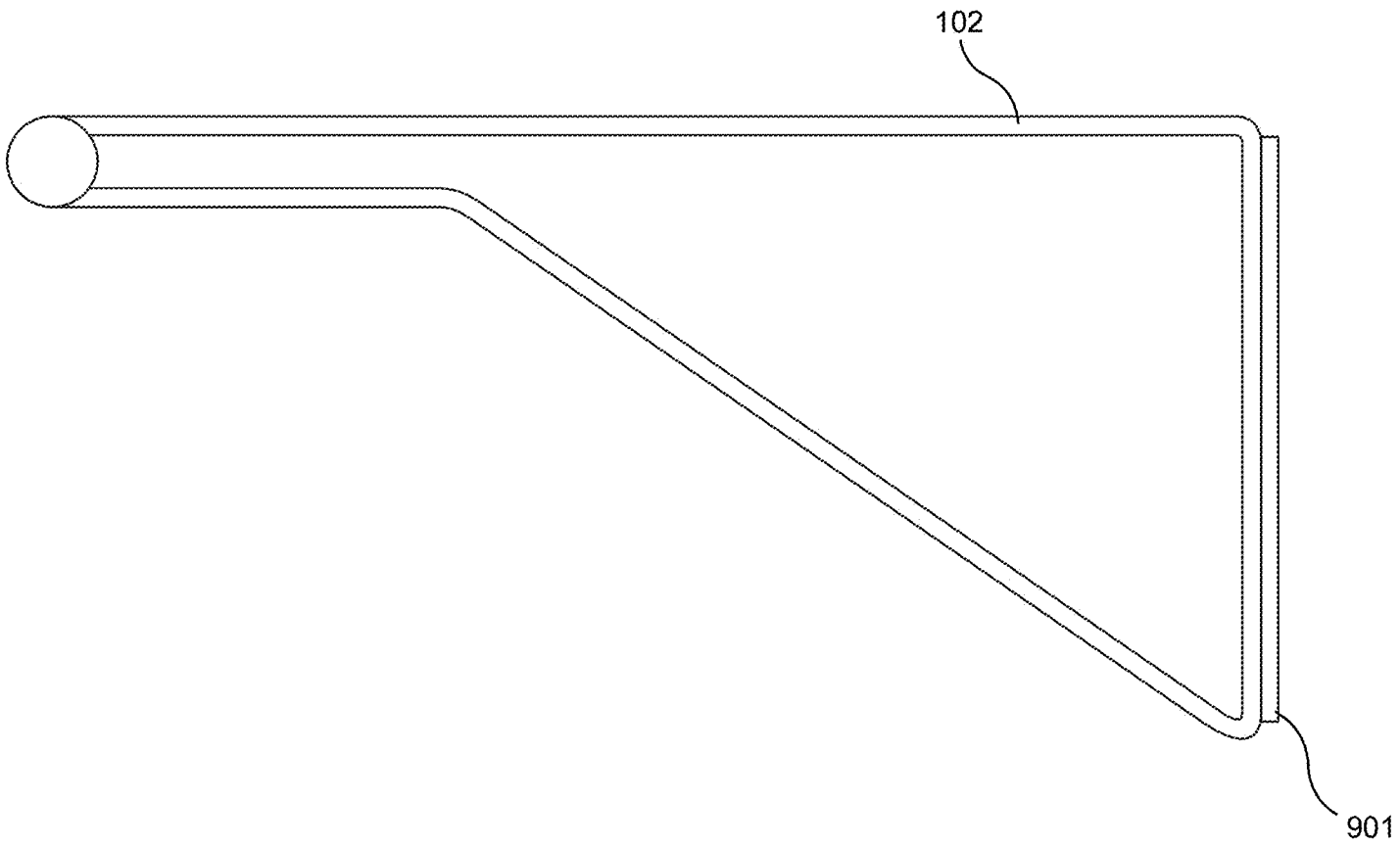
FIG. 7 illustrates a cross-sectional view of a system comprising an additional buffer mechanism secured to the exterior of the second end of the housing and consistent with principles of the present disclosure.

FIGS. 1-7 illustrate embodiments of an action system 100 configured to reduce recoil and muzzle rise in a firearm. FIG. 1 illustrates a side, cross-sectional view of an action system 100 comprising an action spring 101B and a control arm. FIG. 2 illustrates a side, cross-sectional view of an action system 100 comprising an action spring 101B and lever arm 101A in a resting position. FIG. 3 illustrates a side, cross-sectional view of an action system 100 comprising an action spring 101B and lever arm 101A in a fired position. FIG. 4 illustrates a perspective view of the external housing of the action system 100. FIG. 5 illustrates an action system 100 comprising a spacer in lieu of the lever arm 101A. FIG. 6 illustrates an action system 100 comprising an action system 100 comprising an end stop 114. FIG. 7 illustrates a perspective view of the external housing comprising an impact plate.

As illustrated in FIGS. 1-3, the action system 100 generally comprises an outer housing 102, buffer tube 105, buffer 104, lever arm 101A, and action spring 101B. A first arm of the action spring 101B maintains direct contact with the lever arm 101A while a second arm of the action spring 101B is actively engaged with the housing. In this preferred embodiment, the second arm is strategically positioned within the grooves that are formed along the interior wall of the housing, a design feature that serves to inhibit any potential shifting of the action spring 101B within its designated position. The buffer tube 105 is configured to fit within a section of the housing designed with a circular cross-section, and the buffer 104 is configured to slidably move within the buffer tube 105. The front surface of the buffer 104 is designed to come into contact with the bolt carrier group 115, while the rear surface of the buffer 104 is preferably shaped to interface with the lever arm 101A. The action spring 101B is positioned within an internal cavity of the outer housing 102 in a way such that it may act on the buffer 104 as it slides within said buffer tube 105.

In a preferred embodiment, the lever arm 101A is pivotally secured to a lever point of the outer housing 102 and operably connected to the buffer 104. The lever arm 101A is configured to move radially within the inner cavity created by the housing when acted upon by a linear force of the buffer 104. The action spring 101B is in operable communication with the lever arm 101A in a way such that said action spring 101B compresses as the lever arm 101A moves in the direction of the linear force applied thereto by the buffer 104 when the firearm is fired. Compression of the action spring 101B causes the spring force to increase until the spring force is greater than the linear force of the buffer 104, causing the lever arm 101A to push the buffer 104 to a resting position inside the buffer tube 105. In yet another preferred embodiment, the buffer 104 may be configured to engage a spacer that is in contact with the action spring 101B. Accordingly, in some embodiments, the buffer 104 indirectly engages the action spring 101B to reduce recoil and muzzle rise.

Upon the discharge of an AR platform firearm that incorporates the aforementioned action system 100, the linear force exerted by the bolt carrier group 115 is efficiently transferred to the buffer 104. The subsequent movement of the buffer 104, as a reaction to the linear force, causes the lever arm 101A to move radially, prompting the action spring 101B to compress, thereby incrementally increasing the force that the action spring 101B exerts on the buffer 104 through the lever arm 101A. As a result, the action spring 101B acts to absorb and dissipate the linear force, culminating in a noticeable attenuation of the recoil experienced. When the force generated by the action spring 101B surpasses the linear force, the action spring 101B-acting through the lever arm 101A-actively propels the buffer 104 in a direction counter to the linear force, which in turn causes the buffer 104 to forcefully engage with the bolt carrier group 115, thereby repositioning the bolt carrier group 115 into an optimal stance for the initiation of another firing cycle.

As illustrated in FIG. 1, the action system 100 comprises an outer housing 102 and internal components. The outer housing 102 serves as the protective shell for the internal components and is engineered to withstand the forces exerted during firing of a firearm. The outer housing 102 may be constructed from a variety of materials, each selected for their specific properties that contribute to the durability, strength, and overall performance of the action system 100. In some preferred embodiments, high-grade aluminum may be used to construct the outer housing 102 due to its combination of light weight and strength, making it ideal for applications where reducing the overall mass of the firearm is beneficial. In another preferred embodiment, steel may be used to construct the outer housing 102 due to its exceptional strength and resistance to deformation under high-stress conditions, such as those encountered during the firing of a firearm.

In some preferred embodiments, polymers may be used to construct the outer housing 102, which may provide benefits over metal materials. For instance, certain plastics may be used to create a housing possessing corrosion resistance and reduced weight at a lower cost when compared to metal counterparts. Further, outer housings 102 made of polymer may possess complex shapes that are not easily/cheaply obtained when made of metal. Polymer materials may be particularly useful for creating outer housings 102 that are both lightweight and capable of withstanding the environmental stresses associated with firearm use. In some embodiments, polymers such as polyphenylene sulfide (PPS) or polyamide-imide (PAI) may be selected for their high-temperature resistance and mechanical properties. In another preferred embodiment, the outer housing 102 may comprise composite materials, which bind fibers, such as carbon fiber or glass fiber, within a polymer matrix in order to create materials having unique properties. Some composites are known for their high strength-to-weight ratios and can be engineered to provide custom properties, such as increased impact resistance or specific flexural characteristics. In yet another preferred embodiment, the outer casing may be made of a combination of materials. For instance, the outer housing 102 may comprise one or more metal plates suspended within a composite material in a way that provides both strength and protection as well as corrosive resistance.

The outer housing 102 is preferably configured to be broken down into one or more components. In a preferred embodiment, the outer housing 102 comprises two halves that secure together via at least one fastener. In a preferred embodiment, one half of the outer housing 102 may be removed without having to disconnect the entire action system 100 from a firearm. For instance, the halves of the outer housing 102 may be constructed with one or more threaded connections, wherein the two halves may be configured to screw together. In another preferred embodiment, the two halves may be configured to twist together via a single attachment point. For instance, a male threaded attachment point of a first half may be configured to interlock with a corresponding female threaded attachment point of a second half, allowing the two halves to be securely joined by twisting them together.

In one preferred embodiment, the outer housing 102 may be designed with a hinged connection between the two halves, allowing one half to swing open while remaining attached to the other half. This hinge mechanism may include a locking feature to secure the two halves in a closed position during operation of the firearm. In another preferred embodiment, the outer housing 102 may incorporate a sliding mechanism where a first half of the outer housing 102 is configured to slide in relation to a second half of the outer housing 102 to provide access to the internal components. This sliding mechanism may be designed with rails or grooves that guide the movement of the housing halves and ensure proper alignment when closed. In yet another preferred embodiment, the outer housing 102 may utilize a snap-fit design, where the two halves are held together by interlocking features that can be easily engaged and disengaged by hand without the use of tools. This design may include flexible tabs or clips that snap into corresponding slots or recesses on the opposite half. In some preferred embodiments, the outer housing 102 may feature a combination of these mechanisms, such as a hinged connection with a snap-fit or threaded fastener, to provide both ease of access and secure closure.

The internal components of the action system 100 preferably comprise an action spring 101B, lever arm 101A, buffer tube 105, and buffer 104 and are preferably secured to and/or contained within the outer housing 102. The lever arm 101A and action spring 101B are central components to the preferred embodiment of the action system 100 as illustrated in FIGS. 1-3. The lever arm 101A is preferably pivotally secured to a pivot 113 of the housing at a lever end, allowing the lever arm 101A to move radially within said outer housing 102. In a preferred embodiment, the pivot 113 is located at a point within the housing at a distance of at least 1 inch and no greater than 10 inches from the buffer tube 105, wherein said distance as measured in a direction perpendicular to the buffer tube 105. In a preferred embodiment, the pivot 113 is a part of the outer housing 102 and is located within the interior cavity created by the outer housing 102 at point that allows for the lever arm 101A to be of great enough length so that torque created by the directional force of the bolt carrier group 115 and said lever arm 101A is great enough to counter the force of the action spring 101B. In one preferred embodiment, the pivot 113 is an interior feature of the outer housing 102. For instance, an outer housing 102 comprising metal may have a pivot 113 feature seamlessly incorporated into the inner wall. In another preferred embodiment, the pivot 113 may be a feature that is added to the wall of the outer housing 102 and may comprise a separate material. For instance, a steel stud may be partially incorporated into the wall of a housing comprising a composite material in a way that allows the lever arm 101A to secure thereto. In yet another preferred embodiment, the pivot 113 may be a feature of an internal/external frame that is secured to and/or incorporated into said housing.

As illustrated in FIGS. 1-3, the action spring 101B is a torsion spring and, the lever arm 101A is operably connected to the cycle on a cycle side of said lever arm 101A. The torsion spring is engaged with the lever arm 101A on a spring side of said lever arm 101A at point between the pivot end and cycle end of said lever arm 101A. A lever end of the torsion spring is preferably engaged with the lever arm 101A and the other end secured in place within the housing. The torsion spring is configured to exert a counteracting force against the lever arm 101A to counter the linear force of the cycle, thereby reducing the perceived recoil by converting it into angular energy. In a preferred embodiment, a torsion leg spring support of the outer housing 102 is used to secure the torsion spring within the outer housing 102. The torsion spring leg support 112 ensures that the torsion spring remains in its intended position and orientation within the outer housing 102, contributing to the action system's 100 consistent performance. In some preferred embodiments, the torsion spring leg support 112 may be secured to the internal/external frame and not the housing; however, the outer housing 102 may still be shaped in a way that molds itself around the torsion spring even if the torsion spring is supported by the internal/external frame.

In some preferred embodiments of an action system 100, the firearm to which the action system 100 is attached comprises a buffer 104 and buffer tube 105. The buffer tube 105 is preferably designed to be affixed the outer housing 102 and is substantially contained within the internal cavity created by the outer housing 102, providing a protected environment for the buffer tube 105 to function effectively. The buffer tube's 105 positioning within the housing relative the action spring 101B and lever arm 101A is preferably above the action spring 101B and lever arm 101A when said firearm is in an upright position, as illustrated in FIGS. 1-3. In one preferred embodiment, a threaded connection 111 provides a secure and stable link between the buffer tube 105 and the lower receiver 108 of the firearm, a link that is integral to the overall function of the action system 100 with ArmaLite style firearms. Additionally, a buffer set screw 109 may be used to further secure the buffer tube 105 to the lower receiver 108, wherein the buffer set screw 109 prevents movement of the buffer tube 105 in the horizontal direction.

In a preferred embodiment, the buffer tube 105 is characterized by a circular cross-section. The circular cross-section of the buffer tube 105 is not arbitrary but is carefully chosen to align perfectly with the firearm's bolt carrier group 115, which ensures the seamless integration of the action system 100 with the weapon platform. The precise machining/securement of the buffer tube 105, coupled with its strategic positioning in relation to the lever arm 101A and action spring 101B within the outer housing 102, results in an action system 100 that is not only integral to the operation of the firearm it is secured to but also enhances the firearm's performance by effectively managing recoil and muzzle rise.

The buffer 104 is configured to slidably move within the buffer tube 105 and is preferably a modular weighted component, allowing for the adjustment of the buffer's 104 mass to customize the system's response to recoil. The modular design of the buffer 104 permits the addition or removal of weights within the buffer 104, which can be accessed by unscrewing the buffer cap nut 110. This feature enables users to fine-tune the buffer's 104 mass according to their specific recoil preference or operational requirements. In another preferred embodiment, the buffer 104 and its various components may comprise a plurality of materials, each selected for their specific properties that contribute to the overall performance of the weapons platform, depending on the size of the gas port of the upper receiver and strength of the action spring 101B of the action system 100. For instance, the buffer 104 could be made from a high-density material, such as tungsten, to increase its mass without increasing its size and be configured to secure to a rubber buffer tip designed to reduce recoil. For instance, a modular buffer 104 could comprise a steel carbide buffer having an inner cavity configured to accept a plurality of tungsten buffer weights 106 and rubber shock absorbers 107. In a preferred embodiment, the buffer 104 is designed to be easily disassembled for cleaning, maintenance, and/or customization. In a preferred embodiment, a buffer cap nut 110 of the buffer 104 may be removed to allow for access to the internal components of the buffer 104.

In some preferred embodiments, a friction shim 103 may be slotted into a groove of the buffer 104 in a way that prevents the lever arm 101A from wearing down the buffer 104. The friction shim 103 is preferably configured to sit flat against the buffer 104 within the groove, and the lever arm 101A contacts the friction shim 103 within the groove of the buffer 104. As the buffer 104 moves back and forth within the buffer tube 105 as the firearm is cycling, the lever arm 101A will exert pressure on the friction shim 103, which will transfer the spring force to the buffer 104. The friction shim 103 serves as a protective interface between the lever arm 101A and the buffer 104, ensuring that the repeated contact and pressure exerted by the lever arm 101A do not cause undue wear or damage to the buffer 104 itself. This is particularly important in maintaining the longevity and reliability of the action system 100, as the buffer 104 is subjected to significant forces during the operation of the firearm. In a preferred embodiment, the friction shim 103 is typically made from a durable material that can withstand the repeated impacts and friction generated by the lever arm's 101A movement. Suitable materials for the friction shim 103 may include stainless steel, titanium, or brass, which provide superior durability and can effectively distribute the forces exerted by the lever arm 101A. Alternatively, the friction shim 103 may be made from high-strength polymers, such as polyoxymethylene (POM) or ultra-high-molecular-weight polyethylene (UHMWPE), which offer excellent wear resistance and low friction properties.

In a preferred embodiment, the friction shim 103 is shaped to fit snugly within the groove of the buffer 104, ensuring that it remains securely in place during the firearm's operation. The insert's surface that contacts the lever arm 101A is preferably smooth and may be treated or coated to further reduce friction and wear. This smooth surface ensures that the lever arm 101A can move freely against the friction shim 103, minimizing resistance and allowing for efficient transfer of the spring force to the buffer 104. Additionally, some preferred embodiments of the friction shim 103 may be designed with specific geometries or features that enhance its performance. For example, the insert may include internal channels or cavities that help to distribute the forces more evenly across its surface, reducing the risk of localized wear or deformation. These design features can also contribute to the overall stability and alignment of the buffer 104 within the buffer tube 105, ensuring consistent performance of the action system 100.

In some preferred embodiments, the friction shim 103 may be modular, allowing for easy replacement or customization based on the specific needs of the shooter or the operational conditions of the firearm. For instance, different inserts with varying materials or designs can be swapped out to fine-tune the action system's 100 performance. This modularity provides shooters with the flexibility to adapt their firearms to different types of ammunition, shooting styles, or environmental conditions, further enhancing the versatility and effectiveness of the action system 100. The ability to replace the friction shim 103 also simplifies maintenance and extends the overall lifespan of the action system 100, as worn or damaged inserts can be easily replaced without the need to replace the entire buffer 104.

Furthermore, the friction shim's 103 interaction with the lever arm 101A and buffer 104 is designed to optimize the energy transfer within the action system 100. As the firearm cycles, the buffer 104 moves linearly within the buffer tube 105, and the lever arm 101A exerts pressure on the friction shim 103. This pressure is transferred through the insert to the buffer 104, ensuring that the spring force is effectively applied to counter the recoil forces generated during firing. The friction shim's 103 material and design play a crucial role in this energy transfer process, as they must be capable of withstanding the repeated impacts and forces without degrading or losing their effectiveness. By providing a durable and efficient interface between the lever arm 101A and the buffer 104, the friction shim 103 helps to maintain the overall performance and reliability of the action system 100, ensuring that the firearm operates smoothly and consistently under a wide range of conditions.

The bolt carrier group 115, while not part of action system 100, is illustrated in FIGS. 2 and 3 in relation to the action system 100 to illustrate the interaction between the firearm's moving parts and the action system 100 during operation. The position of the bolt carrier group 115 is indicative of its role in the firing cycle and its direct influence on the forces that action system 100 is designed to manage. In the context of an AR platform firearm, the bolt carrier group 115 is a central component that plays a multifaceted role in the firearm's operation. During the firing sequence of an AR platform rifle, the trigger pull releases the hammer, which strikes the firing pin, igniting the primer of the cartridge. The resulting explosion propels the bullet down the barrel while simultaneously generating a high-pressure gas that is redirected through the gas tube into the gas key atop the bolt carrier group 115. This gas pressure exerts a force on the bolt carrier group 115, causing it to move rearward within the upper receiver. The bolt carrier group's 115 rearward movement is resisted by the action system 100, which converts and stores the linear force as potential energy. The action spring's 101B compression serves to slow down and eventually halt the rearward motion of the bolt carrier group 115, thereby mitigating the recoil impulse transmitted to the shooter. Once the energy of the bolt carrier group's 115 rearward movement is absorbed, the action spring 101B releases its stored energy, pushing the lever arm 101A and buffer 104 forward. This forward motion of the buffer 104 applies a force to the bolt carrier group 115, driving it back into battery, stripping a new round from the magazine, and chambering it for the next shot.

FIGS. 2 and 3 illustrate how the buffer 104 and lever arm 101A of the action system 100 are configured to transfer the linear force of the bolt carrier group 115, resulting from the firing of the firearm, to the action spring 101B. As illustrated, when a round is discharged from an AR platform firearm, the bolt carrier group 115 is propelled rearward by the expanding gases, exerting a linear force on the buffer 104. This linear force is then transferred from the buffer 104 to the lever arm 101A, which is pivotally secured within the outer housing 102. The lever arm 101A, acting as a fulcrum, converts the linear motion of the buffer 104 into a radial movement, engaging the torsion spring. Due to the position of the torsion spring relative the lever arm 101A, it resists radial movement caused by the linear force of the bolt carrier group 115. As the lever arm 101A rotates as a result of the firing of the firearm, the torsion spring compresses, storing the energy from the recoil in the form of potential energy. This energy storage process is akin to winding a spring-energy is conserved and can be released in a controlled manner. The compression of the torsion spring effectively decelerates the buffer 104 and, by extension, the bolt carrier group 115, reducing the speed and force of the recoil impulse transmitted to the shooter. Additionally, by converting the recoil energy into rotational energy, the system distributes the forces in a manner that lessens the upward pivot of the firearm. This is achieved by the radial movement of the lever arm 101A, which acts in a plane perpendicular to the axis of the barrel. The rotational motion counterbalances the tendency of the firearm to rise, maintaining a more level orientation throughout the firing cycle.

In another preferred embodiment, as illustrated in FIG. 5, the action system 100 may forgo the use of a lever arm 101A, instead relying on the direct interaction between a spacer, cycle, and action spring 101B. In this embodiment, the spacer, at least partially positioned within the buffer tube 105 and substantially situated within the outer housing 102, acts as an intermediary that receives the linear force from the buffer 104 and efficiently transmits this force to one or more springs within said housing and/or buffer tube 105. The spacer is designed to ensure consistent energy transfer and provide a stable platform for the action spring's 101B compression. Materials and geometries for the spacer are chosen to withstand repeated impacts and maintain structural integrity over time. In some preferred embodiments, the spacer may be configured to absorb energy and dissipate it in a way that further reduces recoil and muzzle rise.

In a preferred embodiment, the action spring 101B, located within the internal cavity of the outer housing 102 and operably connected to the spacer, converts the linear force acting on the spacer into potential energy as it compresses. This compression decelerates the cycle's and spacer's rearward motion, dampening the recoil impulse transmitted to the shooter. The action spring's 101B design parameters, including its rate and preload, are calibrated to achieve the desired recoil mitigation and ensure proper cycling of the firearm. This stored energy assists in repositioning the bolt carrier group 115, readying the firearm for the next shot. The absence of a lever arm 101A in this alternative embodiment simplifies the design and may reduce the number of moving parts, potentially enhancing the reliability and ease of maintenance of the action system 100. This straightforward approach to recoil management allows for easy integration into various firearm platforms.

The material from which the spacer is constructed must be capable of withstanding the energy absorption and dissipation process. Potential materials include a range of polymers, metals, or composite materials, each selected for their durability and energy management properties. These materials are required to be robust enough to handle the frequent and intense recoil forces that occur during the operation of the firearm. In addition, the chosen material must provide adequate structural support and be able to fit precisely within the internal cavity of the housing unit, contributing to the system's overall effectiveness and durability.

Polymers such as high-density polyethylene (HDPE) or polycarbonate may be used for their impact resistance and ability to absorb energy. Metals like aluminum or steel can provide the necessary strength and durability, ensuring that the spacer maintains its structural integrity under repeated stress. Composite materials, which combine the properties of polymers and fibers, can offer a balance of strength, weight, and energy absorption. For instance, carbon fiber-reinforced polymers can provide high strength-to-weight ratios, making them ideal for applications where reducing the overall mass of the firearm is beneficial.

In some embodiments, the spacer may be designed with specific geometries to enhance its energy absorption capabilities. For example, the spacer may include internal cavities or channels that deform under stress, dissipating energy more effectively. These internal cavities can be strategically placed to create controlled deformation zones, which absorb and distribute the recoil forces more evenly throughout the spacer. This design not only improves the energy absorption efficiency but also minimizes the transmission of shock to other components of the action system 100 and the firearm.

Additionally, the spacer's surface may be treated or coated to reduce friction and wear, further enhancing its performance and longevity. Surface treatments such as anodizing, nitriding, or applying lubricious coatings can significantly reduce the friction between the spacer and other moving parts, ensuring smoother operation and reducing the wear and tear on the components. Anodizing can increase the hardness and corrosion resistance of the spacer, making it more durable under harsh conditions. Nitriding can enhance the surface hardness and wear resistance, providing a longer service life for the spacer. Lubricious coatings can minimize friction, allowing the spacer to move more freely within the buffer tube 105 and/or housing, which contributes to the overall efficiency of the action system 100.

Moreover, in some preferred embodiments, the spacer may be modular, allowing for easy replacement or customization based on the shooter's preferences or specific shooting conditions. For instance, different spacers with varying geometries and material properties can be swapped out to fine-tune the action system's 100 performance. This modularity provides shooters with the flexibility to adapt their firearms to different types of ammunition, shooting styles, or operational environments, further enhancing the versatility and effectiveness of the action system 100.

In some preferred embodiments, as illustrated in FIG. 6, an end stop 114 located at the end of the outer housing 102 and/or buffer tube 105 works in conjunction with the lever arm 101A and action spring 101B to further dampen recoil and muzzle rise. The end stop 114 serves as a critical component in the overall recoil management system by providing a terminal point for the cycle's rearward movement, thereby preventing excessive travel and potential damage to the firearm's internal components. The end stop 114 may include additional damping elements, such as an auxiliary spring or elastomeric material, to enhance the recoil reduction capabilities of the action system 100. The end stop 114 may also include adjustable features, allowing for customizable recoil dampening effects, resulting in an action system 100 that not only improves the shooter's accuracy and comfort but also extends the lifespan of the firearm by reducing the stress on its internal components.

In one preferred embodiment of an end stop 114, an auxiliary spring, positioned within the end stop 114, may act as an additional layer of recoil absorption. When the cycle reaches the end of its travel, the auxiliary spring compresses, absorbing any remaining kinetic energy and reducing the impact force transmitted to the shooter. This auxiliary spring can be calibrated to provide a specific amount of resistance, allowing for further customization of the recoil characteristics. The use of an auxiliary spring ensures that the action system 100 can handle a wide range of recoil forces, making it adaptable to different firearm calibers and shooting conditions.

In another preferred embodiment of an end stop 114, elastomeric materials, such as rubber or polyurethane, may be used to provide additional damping. These materials are known for their excellent energy absorption properties and can assist with the dissipation of recoil energy over a larger area, reducing the peak force experienced by the shooter. In a preferred embodiment, the elastomeric material may be molded to fit precisely within the end stop 114, ensuring consistent performance and durability. In another preferred embodiment, the end stop 114 may be at least partially constructed of the elastomeric material. The combination of an auxiliary spring and elastomeric material within the end stop 114 may provide a multi-stage damping effect, further enhancing the overall recoil reduction and muzzle rise capabilities of the action system 100.

In yet another preferred embodiment, the end stop 114 may comprise adjustable features, allowing the user to fine-tune the amount of damping provided by the end stop 114. For example, the auxiliary spring's preload can be adjusted by changing its position within the end stop 114. For example. The spring or elastomeric inserts may be swapped out to achieve the desired level of recoil reduction. This adjustability ensures that the action system 100 can be tailored to the specific needs and preferences of the shooter, providing a customizable and versatile solution for recoil management.

In some preferred embodiments, the system may further comprise a plurality of grooves 601 on the internal surface of the housing. In embodiments comprising an internal/external frame, the plurality of grooves 601 may be incorporated into the internal/external frame. By incorporating a plurality of grooves 601 into the outer housing 102, the system enables the user to adjust the initial spring force exerted by the action spring 101B. This adjustability allows for customization of the action system's 100 performance to suit individual preferences or specific shooting conditions, such as different ammunition loads or recoil sensitivities. The user can modify the tension of the action spring 101B by selecting the appropriate groove for the action spring's leg to rest in, thereby altering the recoil and muzzle rise characteristics of the firearm. This feature provides a means for fine-tuning the firearm's behavior, enhancing the shooting experience by optimizing the balance between recoil mitigation and the firearm's cycling action.

The grooves are strategically positioned along the internal surface of the housing to provide multiple points of engagement for the action spring 101B. Each groove corresponds to a different level of spring tension, allowing the user to increase or decrease the initial force exerted by the action spring 101B. This adjustability is particularly beneficial for shooters who use a variety of ammunition types, as different loads can produce varying levels of recoil. By selecting the appropriate groove, the shooter can ensure that the action system 100 is optimally tuned for the specific ammunition being used, resulting in a more consistent and comfortable shooting experience.

In some embodiments, the grooves may be designed with varying depths and angles to provide a range of tension adjustments. For example, shallower grooves may offer less spring tension, suitable for lighter ammunition loads, while deeper grooves may provide greater tension for heavier loads. The angles of the grooves can also influence the action spring's 101B engagement, with steeper angles providing a more aggressive tension increase. This level of customization allows the shooter to fine-tune the action system 100 to their exact preferences, ensuring optimal performance under a wide range of conditions.

Additionally, the grooves can be designed to accommodate different types of springs, further enhancing the action system's 100 versatility. For instance, the grooves may be compatible with both torsion springs and compression springs, allowing the user to switch between spring types based on their specific needs. The incorporation of grooves into the internal surface of the housing may also contribute to the overall durability and reliability of the action system 100. By providing secure engagement points for the action spring 101B, the grooves help to prevent unwanted movement or shifting of the action spring 101B during operation. This stability ensures that the action spring 101B maintains consistent tension and performance, even under the intense forces generated during firing.

The outer housing 102 may further comprise an internal/external frame designed to enhance the structural integrity of the action system 100. The internal/external frame is strategically positioned within or external to the outer housing 102 to counteract the linear force exerted by a firearm upon discharge. The internal/external frame is preferably constructed from a material selected for its high tensile strength and ability to absorb and distribute the stresses associated with the firing of a firearm, thereby preventing deformation of the housing and maintaining the action system's 100 overall functionality. In a preferred embodiment, the internal/external frame is integrated into the outer housing 102 during the assembly process, ensuring that it remains firmly in place during use.

Embodiments comprising an internal/external frame preferably have the internal frame strategically positioned within the housing in a way that counteracts the linear force exerted by a firearm upon discharge. By distributing the forces generated during firing, the internal frame helps to mitigate the impact on the outer housing 102, reducing the risk of damage and prolonging the lifespan of the action system 100. This design consideration is particularly important for firearms that experience high levels of stress and recoil, as it ensures that the action system 100 can withstand repeated use without compromising its performance. In one preferred embodiment of an internal frame, the internal frame may be conformed to the area in which the action spring 101B is to be seated within the outer housing 102. Further, the internal frame may be secured within the outer housing 102 in a way that spreads rotational energy over a larger area to reduce the chance of structural failure. This conformation ensures that the action spring 101B remains securely in place during the operation of the firearm, preventing any unwanted movement that could lead to inconsistent performance or damage to the action system 100. The internal frame's design may include specific features such as reinforcing ribs or gussets that provide additional support to the action spring 101B, ensuring that it can effectively absorb and dissipate the forces generated during firing. Further, the internal/external frame may comprise the plurality of grooves 601, allowing for the action spring 101B to be more securely positioned within the housing as well as allow the user to more finely tune how the action system 100 interacts with the bolt carrier group 115.

In another preferred embodiment of an internal frame, the internal frame may be configured to securely fit the buffer tube 105. This secure fit ensures that the buffer tube 105 remains aligned with the other components of the action system 100, preventing any misalignment that could lead to increased wear or failure of the action system 100. The internal frame may include features such as precision-machined slots or channels that guide the buffer tube 105 into place, ensuring a snug fit that enhances the overall stability and performance of the action system 100. Additionally, the internal frame may be designed to accommodate different sizes and types of buffer tubes 105, providing versatility and compatibility with a wide range of firearm platforms. In yet another preferred embodiment of an internal frame, the internal frame may comprise a pivot 113 made of a material designed to withstand friction forces and the forces acting on the lever arm 101A. The pivot 113 is a critical component of some embodiments of the action system 100 because it allows the lever arm 101A to move radially in response to the linear force exerted by the buffer 104 and bolt carrier group 115. Accordingly, the material chosen for the pivot 113 must be capable of withstanding the repeated stresses and friction generated during the operation of the firearm, ensuring that the lever arm 101A can move smoothly and consistently. For instance, the outer shell may comprise HDPE whereas the pivot 113 may comprise a nickel alloy, which would provide the necessary durability and resistance to wear. Additionally, some embodiments of the internal frame may be treated with surface coatings or lubricants to further reduce friction and enhance its performance.

In yet another preferred embodiment of the internal frame, the internal frame may be designed with modular frame units that can be easily replaced or upgraded. This modularity allows for customization of the action system 100 to suit the specific needs and preferences of the shooter. For instance, a frame unit may be designed in a way that allows for the securement of buffer tubes 105 of varying sizes, allowing a user to customize the buffer system of the action system 100. Further, some embodiments of the modular frame units may simplify maintenance and repair by allowing for individual components to be replaced without the need to disassemble the entire action system 100. For instance, a frame unit may comprise a pivot 113 configured to removably attach thereto, allowing the user to change out a damaged pivot 113 without needing to replace the outer housing 102. In another preferred embodiment of an internal frame having modular frame units, separate frame units may be configured in a way such that they may connect to the outer shell and other frame units or connect only to the outer shell or only to other frame units. For example, a pivot 113 made of a nickel-steel allow may be incorporated into an outer shell made of HDPE, obviating the need for a modular frame unit comprising a pivot 113.

However, the user may add a modular frame unit that allows for easy modification of the buffer system and/or a modular frame unit that provides additional support for the action spring 101B, wherein these two modular frame units may or may not be secured to one another.

Some embodiments of an internal/external frame may comprise an external frame configured to secure to the exterior of the outer shell and provide additional support and/or features. By securing the external frame to the exterior of the outer shell, the external frame may act as a reinforcing skeleton that distributes the forces generated during firing more evenly across the entire structure of the action system 100. This distribution helps to mitigate the impact on the outer shell, reducing the risk of deformation or damage and ensuring that the action system 100 remains robust and reliable even under high-stress conditions. In some preferred embodiments, the external frame may be designed with specific geometries and materials to maximize its strength and durability.

For instance, the ribs, gussets, and cross-bracing may be used to add rigidity and support to the frame. Reinforcing ribs, for example, can be strategically placed along the length of the frame to provide additional support and prevent flexing or bending under load. Gussets can be used at key junctions to distribute stress more evenly and reduce the risk of cracking or failure. Cross-bracing can create a lattice-like structure that enhances the overall stability and strength of the frame. The external frame may also comprise surface treatments and coatings that enhance its durability and resistance to wear. For example, anodizing can be used to create a hard, protective layer on aluminum components, improving their resistance to corrosion and wear. Nitriding can be used to enhance the surface hardness of steel components, reducing friction and extending their service life. Additionally, lubricious coatings can be applied to reduce friction between moving parts, improving the overall efficiency and performance of the action system 100.

In some preferred embodiments, the external frame may be used to incorporate additional functional elements that enhance the versatility and customization options of the action system 100. For example, the frame can include mounting points for accessories such as a cheek riser, lights, impact plate, or ammunition holder, allowing the user to tailor the firearm to their specific needs and preferences. These mounting points can be designed to be compatible with standard accessory interfaces, ensuring that a wide range of aftermarket components can be easily attached and adjusted. In yet other preferred embodiments, the external frame may incorporate modular components that can be easily replaced or upgraded. This modularity allows for customization of the action system 100 to suit the specific needs and preferences of the shooter. For example, different frame modules with varying geometries and materials can be swapped out to achieve the desired level of performance or to accommodate specific accessories. This modular design also simplifies maintenance and repair, as individual components can be replaced without the need to disassemble the entire action system 100.

The internal/external frame is preferably constructed from a material selected for its high tensile strength and ability to absorb and distribute the stresses associated with the firing of a firearm, thereby preventing deformation of the housing and maintaining the system's overall functionality. In a preferred embodiment, high tensile strength materials such as steel, aluminum, or titanium are used due to their ability to withstand significant forces without deforming. In embodiments requiring very high tensile strength, steel may be used to construct the internal/external frame due to its exceptional strength and durability. In embodiments requiring weight mitigation, aluminum and titanium may be used to construct the internal/external frame due to a good strength to weight ratio. In yet another preferred embodiment, lightweight materials, such as magnesium alloys, carbon fiber-reinforced polymers, glass fiber-reinforced polymers, and composite materials may be used to construct the internal external frame, providing durability while reducing weight.

The internal/external frame may be attached to the housing using various methods, such as welding, bolting, or adhesive bonding, depending on the materials and design requirements. This secure attachment ensures that the internal/external frame remains firmly in place during use, providing consistent support and alignment for the action system 100 components. In embodiments of an outer housing 102 comprising metal, welding may be used to create a strong, permanent bond between the outer housing 102 and internal/external frame. Welding is particularly suitable for materials such as steel and aluminum, which can be easily welded using various techniques such as MIG, TIG, or spot welding. Bolting the internal/external frame to the outer housing 102 may be particularly advantageous for applications where maintenance or replacement of components may be required, as it allows for easy removal and reattachment of the internal/external frame. This attachment method is suitable for a wide range of materials, including metals and composites, and can be used in conjunction with other attachment methods to enhance the overall strength and stability of the connection.

In another preferred embodiment, adhesive bonding may be used to secure the internal/external frame to the outer housing 102, particularly when the components are made of different materials or when a seamless appearance is desired. This method may be particularly effective for materials such as polymers and composites, which may not be suitable for welding or bolting. Adhesive bonding can provide a high-strength connection that distributes stresses evenly across the joints, reducing the risk of localized failure. Additionally, adhesive bonding may be used in combination with other attachment methods to enhance the overall strength and durability of the connection. It yet another preferred embodiment, the internal/external frame may be at least partially molded into the outer housing 102, enhancing structural integrity, improving load distribution, and providing greater customization options. This integration can be achieved through advanced manufacturing techniques such as injection molding and 3D printing. For instance, a HDPE may be injected into an internal cavity of a mold wherein at least a portion of the internal/external frame is contained within said internal cavity. The HDPE flows around the internal/external frame, filling the mold and encapsulating the frame within the HDPE and conforming to the mold's features. The mold is then cooled to allow the HDPE to solidify, forming a cohesive and integrated structure.

In some preferred embodiments, a combination of these attachment methods may be used to secure the frame to the housing. For example, bolting may be used to provide primary structural support, while adhesive bonding can be used to enhance the overall strength and stability of the connection. For instance, injection molding may be used to incorporate a part of the internal frame into the outer housing 102 and bolting may be used to connect the external frame to the exterior of the outer housing 102. This multi-method approach ensures that the frame remains securely secured to the housing, providing consistent support and alignment for the action system 100 components.

As illustrated in FIG. 7, an impact plate may be secured to the exterior surface of the outer housing 102 at the posterior end. The impact plate is configured to absorb and dissipate energy, contributing to the reduction of recoil experienced by the user. The specific dimensions and material properties of the impact plate are selected to optimize the performance of the impact plate in conjunction with the other components of the system. The impact plate may be constructed from a variety of materials known for their energy absorption and dissipation properties, including but not limited to rubber, which provides excellent shock absorption. Other suitable materials may include high-impact plastics, composite materials, or metals with energy-dissipating coatings, all chosen to enhance the overall performance of the system.

In some preferred embodiments, the impact plate may feature a contoured shape that conforms to the user's shoulder, distributing the recoil force over a larger area and thereby reducing the felt impact. This ergonomic design not only enhances comfort but also improves the shooter's control over the firearm, contributing to better accuracy and overall shooting experience. The thickness and density of the impact plate can be adjusted to provide the desired level of energy absorption, ensuring that it effectively mitigates the recoil forces generated during firing. High-impact plastics, such as polycarbonate or ABS, can be used to construct the impact plate due to their durability and ability to absorb shock. These materials are lightweight yet strong, making them ideal for applications where reducing the overall weight of the firearm is beneficial. Composite materials, which combine the properties of different substances, can offer a balance of strength, weight, and energy absorption. For instance, carbon fiber-reinforced polymers can provide high strength-to-weight ratios, making them suitable for high-performance applications.

In some embodiments, the impact plate may incorporate additional features to enhance its performance. For example, it may include internal cavities or channels that deform under stress, dissipating energy more effectively. These features can be strategically placed to create controlled deformation zones, which absorb and distribute the recoil forces more evenly throughout the impact plate. This design not only improves the energy absorption efficiency but also minimizes the transmission of shock to the user's shoulder. The impact plate may also be designed to be modular, allowing for easy replacement or customization based on the shooter's preferences or specific shooting conditions. Different impact plates with varying materials, thicknesses, and designs can be swapped out to fine-tune the action system's 100 performance. This modularity provides shooters with the flexibility to adapt their firearms to different types of ammunition, shooting styles, or operational environments, further enhancing the versatility and effectiveness of the action system 100.

Additionally, the impact plate's surface may be treated or coated to reduce friction and wear, further enhancing its performance and longevity. Surface treatments such as texturing or applying non-slip coatings can improve the grip and stability of the firearm against the user's shoulder, ensuring consistent performance even in adverse conditions. These treatments can also enhance the aesthetic appeal of the impact plate, providing a professional and polished appearance.

In some preferred embodiments, the various components of the action system 100 may be treated with surface finishes or coated with materials that reduce friction, thereby enhancing their durability and reducing wear over time. These treatments can include processes such as anodizing, nitriding, or the application of lubricious coatings, all of which contribute to the smooth operation of the system and extend its service life. Anodizing can be used to improve the resistance of the components to wear and corrosion, enhance their aesthetic appeal, and provide a better surface for the adhesion of paints and primers. Anodizing can be particularly beneficial for aluminum components, as it can increase their hardness and resistance to wear. Nitriding can be used to improve the hardness and wear resistance of the components, reduce their friction coefficient, and increase their fatigue and yield strength. Nitriding can be particularly beneficial for steel components, as it can increase their surface hardness without affecting their core properties. Lubricious coatings can reduce the friction between the components, thereby reducing wear and extending their service life. Lubricious coatings can be particularly beneficial for moving parts, as they can reduce the energy lost to friction and improve the efficiency of the system.

The implementations set forth in the foregoing description do not represent all implementations consistent with the subject matter described herein but are examples consistent with the disclosed subject matter. Although variations have been described in detail above, other modifications or additions may be possible. In particular, further features and/or variations may be provided in addition to those set forth herein. For example, the implementations described above may be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter may be made without departing from the principles and scope of the present disclosure.

What is claimed is:

1. An action system for a firearm comprising:

a buffer of a firearm in operable communication with a torsion spring via a lever arm, wherein said lever arm is pivotally connected to a lever point at a lever end, wherein said lever point is positioned below said buffer when said firearm is in an upright position, wherein said torsion spring exerts a spring force on said lever arm, wherein said lever arm moves radially about said lever point when acted upon by a linear force acting on said buffer, and wherein compression of said torsion spring by said lever arm via said linear force acting on said buffer causes said spring force of said torsion spring to increase until a lever force acting on said buffer is greater than said linear force acting on said buffer, forcing said buffer into a direction opposite said linear force.

2. The action system of claim 1, further comprising a buffer tube configured to allow said buffer to slidably move therein to compress said torsion spring via said lever arm.

3. The action system of claim 1, further comprising a friction shim configured to fit within a slot of said buffer, wherein said friction shim is in direct communication with said lever arm that is operably connected to said torsion spring.

4. The action system of claim 1, further comprising a housing configured to hold a portion of said torsion spring in a fixed position relative to said buffer.

5. The action system of claim 4, further comprising a plurality of grooves of said housing, wherein said plurality of grooves is configured to hold said torsion spring in a way such that said spring force is increased while in a resting position.

6. The action system of claim 1, further comprising an end stop having at least one dampening element, wherein said end stop is located within a path of said linear force and positioned in a way such that said at least one dampening element of said end stop dampens said linear force.

7. An action system for a firearm comprising:

a lever arm operably connected to a spring and a buffer of a firearm, wherein a buffer end of said lever arm is in contact with said buffer, wherein said lever arm moves radially about a lever point when acted upon by a linear force acting on said buffer, wherein said lever point is positioned below said buffer when said firearm is in an upright position, wherein said buffer is in operable communication with a spring, wherein compression of said spring by said lever arm via said linear force acting on said buffer causes a spring force of said spring to increase until a lever force acting on said buffer is greater than said linear force acting on said buffer, forcing said buffer into a direction opposite said linear force.

8. The action system of claim 7, further comprising a buffer tube configured to allow said buffer to slidably move therein to engage said lever arm.

9. The action system of claim 7, further comprising a friction shim configured to fit within a slot of said buffer, wherein said friction shim is in direct communication with said lever arm.

10. The action system of claim 7, further comprising a housing configured to hold a portion of said spring in a fixed position relative said buffer.

11. The action system of claim 10, further comprising a plurality of grooves said housing, wherein said plurality of grooves is configured to hold said spring in a way such that said spring force is increased while in a resting position.

12. The action system of claim 7, further comprising an end stop having at least one dampening element, wherein said end stop is located within a path of said linear force and positioned in a way such that said at least one dampening element of said end stop dampens said linear force.

13. An action system for a firearm comprising:

a buffer of a firearm in operable communication with a spring via a lever arm, wherein a buffer end of said lever arm is in contact with said buffer, wherein compression of said spring by a linear force acting on said buffer causes a spring force of said spring to increase until a lever force of said lever arm is greater than said linear force acting on said buffer, forcing said buffer into a direction opposite said linear force, a buffer tube configured to allow said buffer to slidably move therein to engage said lever arm that is operably connected to said buffer and said spring, wherein said lever arm moves radially about a lever point when acted upon by said linear force acting on said buffer, compressing said spring and increasing said spring force, wherein said lever point is positioned below said buffer tube when said firearm is in an upright position, and a housing configured to hold a portion of said spring in a fixed position relative said buffer.

14. The action system of claim 13, further comprising a friction shim configured to fit within a slot of said buffer, wherein said friction shim is in direct communication with said lever arm.

* * * * *